United States Patent [19]

Takahashi et al.

[11] Patent Number: 5,015,910

[45] Date of Patent: May 14, 1991

[54] ELECTRON GUN FOR COLOR PICTURE TUBE

[75] Inventors: Yoshiaki Takahashi, Chiba; Sakae Ishii, Mobara; Masayoshi Furuyama, Togane; Shoji Shirai, Mobara, all of Japan

[73] Assignees: Hitachi, Ltd., Tokyo; Hitachi Device Engineering Co., Ltd., Chiba, both of Japan

[21] Appl. No.: 406,321

[22] Filed: Sep. 12, 1989

[30] Foreign Application Priority Data

Sep. 16, 1988 [JP] Japan ..... 63-230116

[51] Int. Cl.[5] ..... H01J 29/50; H01J 29/56; H01J 29/58

[52] U.S. Cl. ..... 313/414; 313/460; 313/409; 315/16

[58] Field of Search ..... 313/414, 412, 413, 411, 313/409, 458, 460; 315/382, 14, 370, 15, 16, 17

[56] References Cited

U.S. PATENT DOCUMENTS 4,086,513 4/1978 Evans, Jr. ..... 313/414
4,772,827 9/1988 Osakabe ..... 313/414 X

FOREIGN PATENT DOCUMENTS 62-58549 3/1987 Japan .

*Primary Examiner*—Palmer C. DeMeo
*Assistant Examiner*—John Giust
*Attorney, Agent, or Firm*—Antonelli, Terry, Stout & Kraus

[57] ABSTRACT

A novel electron gun for the color picture tube is disclosed, which comprises at least a cathode for emitting three electron beams in alignment and focusing electrodes for focusing the electron beams emitted from the cathode. The forcusing electrodes include first and second focusing electrodes for passing electron beams. The first focusing electrode includes a plurality of perpendicular plate electrodes arranged in such a manner as to sandwich the electron beams along the direction of arrangement thereof after being passed through the passage apertures and rim electrodes surrounding the perpendicular plate electrodes. The second focusing electrode includes a couple of horizontal plate electrodes arranged in such a manner as to hold the electron beams along the direction perpendicular to the direction of arrangement thereof after being passed through passage apertures and extending in opposed relationship with the perpendicular plate electrodes and rim electrodes along tht electron gun axis. The resolution of the peripheral parts of the display surface of the picture tube is thus improved and the assembly of the electron gun thereof is facilitated.

12 Claims, 12 Drawing Sheets

FIG. 7

ELECTRON GUN FOR COLOR PICTURE TUBE

BACKGROUND OF THE INVENTION

The present invention relates to an electron gun for the color picture tube comprising an electronic lens configuration capable of producing a high resolution and a superior convergence characteristic over the entire range of the phosphor screen of the color picture tube.

The resolution of the picture tube depends to a large measure on the diameter of the electron beam spot and the shape thereof. Specifically, a high resolution cannot be obtained unless the electron beam spot which is formed as a bright spot on the phosphor screen by the bombardment of an electron beam is small in diameter or near to the true circle.

In view of the fact that the electron beam track from the electron gun to the phosphor screen surface is lengthened with the increase in the deflection angle of the electron beam, however, if the optimum focus voltage is maintained to produce a truely circular electron beam spot small in diameter at the central part of the phosphor screen surface, an overfocused condition would result at the peripheral part of the phosphor screen, thereby making it impossible to produce a superior electron beam spot or a high resolution at the peripheral part.

In order to solve this problem, what is called the dynamic focus system has so far been employed in which the focus voltage is increased with the deflection angle of the electron beam to weaken the main lens electric field. This system, however, is not suitable for the driving of an in-line color picture tube as explained below.

Specifically, in an in-line color picture tube with three electron beam emitters arranged in alignment along the horizontal scanning direction, the horizontal-deflection magnetic field distribution and the vertical-deflection magnetic field distribution are distorted in pin-cushion and barrel forms respectively in order to produce a self-convergence effect, and therefore the electron beam that has passed this part is distorted into a non-circular form.

The phosphor screen, which is normally a laterally long rectangle with a long side in the direction of electron beam arrangement (horizontal direction), has an especially great distortion at the horizontal peripheral part.

FIG. 1 is a diagram for explaining the relationship between a four-pole lens magnetic field and electron beams. Numerals 1, 2 and 3 designate electron beams and numeral 4 a horizontal-deflection magnetic field.

A diagram for explaining the relationship between the horizontal-deflection magnetic field in the pin-cushion magnetic distribution and an electron beam is shown in FIG. 2, in which numeral 6 designates a two-pole magnetic field component, numeral 7 a four-pole magnetic field component, and numeral 9 an electron beam.

FIG. 3 shows a diagram for explaining the shape distortion of a beam spot, in which numeral 9H designates a high-brightness part (core) of the electron beam and numeral 9L a low-brightness part (haze part) thereof.

In FIG. 1, three electron beams 1, 2 and 3 advanced from the back of the page enter the horizontal-deflection magnetic field 4 in pin-cushion distribution and are deflected in the direction indicated by the arrow 5.

Specifically, the horizontal-deflection magnetic field of pin-cushion distribution is considered to be comprised of the two-pole magnetic field component 6 as shown in FIG. 2(*a*) and the four-pole magnetic field component 7 as shown in FIG. 2(*b*). The two-pole magnetic field component 6 exerts the effect of deflection on the electron beam 9 in the direction shown by arrow 8.

The four-pole magnetic field component 7 exerts a self-convergence effect on three electron beams. As to a single electron beam 9, however, the horizontal scattering and the vertical convergence leads to a sectional form laterally long and flat.

The scattering effect works in such a direction as to cancel the overfocus of the electron beam spot as a result of a lengthened electron beam track with the increase in electron beam deflection angle, and therefore the optimum focus condition is maintained during the deflection period in the horizontal direction of the electron beam spot in an in-line color picture tube. In the vertical direction, however, the degree of overfocus is extremely increased by adding the above-mentioned convergence effect.

As a consequence, the electron beam spot formed at the cental part of the phosphor screen assumes a circular form as shown by "00" of FIG. 3, while the electron beam spot formed at the horizontal peripheral part is distorted into a non-circular form including a high-brightness core 9H and a low-brightness haze 9L. Especially, the great elongation along the vertical direction of the haze section 9L has an adverse effect on the focus characteristic.

In this case, if a conventional dynamic focus system is used, however, the function of the main lens is weakened uniformly either in horizontal or vertical direction, and therefore even if the haze section 9L is removed for the vertical direction, an underfocus condition is developed in the horizontal direction in spite an already-optimum focus condition, thereby increasing the horizontal diameter.

As a result, the electron beam spot is extremely lengthened horizontally for a reduced resolution in the horizontal direction.

A picture tube unit which has solved this problem and is capable of producing a high resolution over the entire range of the phosphor screen is disclosed in JP-A-62-58549.

FIG. 4 is a diagram for explaining the electron gun of a picture tube unit disclosed in the aforementioned patent publication, in which FIG. 4(*a*) is a general sectional view of the electron gun, FIG. 4(*b*) a front view of a first focusing electrode, and FIG. 4(*c*) a front view of a second focusing electrode. Numerals 10*a*, 10*b* and 10*c* designate cathodes, numeral 110 a control electrode, numeral 120 an accelerating electrode, numeral 130 a first focusing electrode, numeral 140 a second focusing electrode, numeral 150 an anode, and small alphabetical characters affixed to the numerals 110 to 150 respective electron beam passage apertures. Character C designates an electron gun axis (coinciding with the tube axis), character $L_M$ a main lens, and characters $S_1$ to $S_4$ distances of the side electron beam passage apertures of each electrode from the electron gun axis C (coinciding with the center electron beam).

In FIG. 4, at least the accelerating electrode 120, the first focusing electrode 130 and the second focusing electrode 140 are arranged sequentially along the tube axis between the control electrode 110 and the anode 150. Vertical electron beam passage apertures 130*d*, 130*e* and 130*f* are arranged at the end of the first focusing electrode 130 on the side of the second focusing electrode 130, and the lateral electron beam passage apertures 140*a*, 140*b* and 140*c* at the end of the second focusing electrode 140 near to the first focusing electrode 130.

The unit has voltage application means for applying a first predetermined focus voltage to the first focusing electrode 130, a predetermined high voltage to the anode 150, and a dynamic voltage changing to a higher value than the first focus voltage with the increase in the deflection angle of the electron beam to the second focusing electrode 140.

In this configuration, at the time when the horizontal deflection is zero, that is, when the first focusing electrode 130 and the second focusing electrode 140 are both at the same potential, the electron beams are not substantially affected regardless of whether the electron beam passage apertures of the electrodes are longitudinal (long in the vertical direction, that is, in the direction perpendicular to the horizontal direction) or in the lateral direction (long in the horizontal direction).

A potential difference is thus caused between the second focusing electrode 140 and the another 150, and the resulting three main lenses $L_M$ formed at this point cause three electron beams to be focused at optimum convergence at the central part of the phosphor screen.

With the increase in the horizontal deflection angle, the potential of the second focusing electrode 140 becomes higher than that of the first focusing electrode 130, thereby generating a four-pole lens electric field between the two electrodes by the longitudinal electron beam passage apertures 130*d*, 130*e* and 130*f* and lateral electron beam passage apertures 140*a*, 140*b* and 140*c*.

Also, the reduction in the potential difference between the second focusing electrode 140 and the anode 150 weakens the function of the main lenses.

FIGS. 5 and 6 are diagrams for explaining the effect that the four-pole lens electric field has on the electron beam. In these diagrams, for facilitating understanding, a flat electrode 213 having a single longitudinal electron beam passage aperture 212 is arranged in opposed relationship with a flat electrode 215 having a single lateral electron beam passage aperture 14, and potentials $V_1$ and $V_2$ are applied to them.

In FIG. 5, the four-pole lens electric field formed between the two electrodes under the voltage condition satisfying $V_1<V_2$, as shown in FIG. 6, is positive in potential at upper and lower parts and negative at right and left parts with respect to the central part. As a result, electric lines of force are generated in the direction indicated by arrow 216, so that the electron beam 217 assumes a longitudinal section under attractive and repulsive forces in the direction indicated by arrows 216.

This is in contrast with the case in which the electron the beam that has passed the deflection magnetic field assumes a lateral section due to the four-pole magnetic field components shown in FIG. 2(*b*). It is thus possible to prevent the electron beam from flattening laterally by the two fields offsetting with each other.

Further, with the increase in deflection angle, the focusing function of the main lens is reduced as mentioned above, and therefore overfocusing due to the deflection of an electron beam spot is prevented at the same time. An electron beam spot small in diameter and almost true in roundness is generated even along the peripheral parts of the phosphor screen.

Also, in FIG. 4, the application of a dynamic focus voltage to the second focusing electrode 140 is liable to cause a displacement of convergence between three electron beams. As a measure against this, the relationship $S_4<S_3<S_1<S_2$ is maintained, where $S_1$ is the distance of the side electron beam passage apertures 110*b*, 110*c*, 120*b* and 120*c* of the control electrode 110 and the accelerating electrode 120 from the electron gun axis C (coinciding with the electron beam and tube axis), $S_2$ is the distance of the side electron beam passage apertures 130*b* and 130*c* at the end of the first focus electrode 130 near to the accelerating electrode 120 from the electron gun axis C, $S_3$ is the distance of the side electron beam passage apertures 130*e*, 130*f*, 140*b* and 140*c* at the opposed ends of the first focusing electrode 130 and the second focusing electrode 140 from the electron gun axis C, and $S_4$ is the distance of the side electron beam passage apertures 140*e*, 140*f*, 150*b* and 150*c* at the opposed ends of the second focusing electrode 140 and the anode 150 from the electron gun axis C.

As a result, the orbital axis of the side electron beams is maintained constant with respect to the change in dynamic voltage, thereby minimizing the misconvergence of the side electron beam and the electron beam spot distortion caused by the distortion of the deflection magnetic field.

In the aforementioned prior art, in changing the dynamic voltage of the second focusing electrode, the distance of three electron beam passage apertures between the control electrode and the first focusing electrode, between the first focusing electrode and the second focusing electrode, and between the second focusing electrode and the anode is changed in order to concentrate the three electron beams emitted in lateral alighment from the cathode on the screen surface.

This makes it necessary to use a special electron gun assembly jig for matching the electron beam passage aperture distances S1, S2, S3 and S4 with each other and the longitudinal electron beam passage aperture of the first focusing electrode with the lateral electron beam passage aperture of the second focusing electrode in assemblying the respective electrodes, thus making the assembly work extremely difficult and unsuitable for mass production.

SUMMARY OF THE INVENTION

The object of the present invention is to provide an electron gun for the color picture tube in which an electron lens of a novel electrode configuration is used to secure a high resolution and superior convergence characteristic over the entire screen area and in which electrodes are easily assmbled, thus obviating the disadvantages of the aforementioned prior art.

This object is achieved by a configuration in which at least a control electrode, an accelerating electrode, focusing electrodes and an anode are arranged along the electron gun axis against the cathode for emitting three electron beams aligned in horizontal scanning direction (hereinafter refered to as "the horizontal direction"), the focusing electrodes include a first focusing electrode and a second focusing electrode, the first focusing electrode includes a longitudinal or three circular electron beam passage apertures in accordance with the number of electron beams involved, these electron beam passage apertures are held from the direction of electron beam arrangement by a plurality of parallel flat electrodes (vertical plates) secured along the direction of the second focusing electrode, these parallel flat electrodes are surrounded by a rim electrode, and a lateral or three circular electron beam passage apertures according to the number of electron beams involved are held in the direction perpendicular to the electron beam arrangement (vertical direction) by a couple or three couples of parallel flat electrodes (horizontal plates) secured on the second focusing electrode along the direction of the first focusing electrode.

A four-pole lens electric field is formed by the parallel flat electrodes (vertical plates) holding the electron beam passage apertures of the first focusing electrode and the parallel flat electrodes (horizontal plates) holding the electron beam passage apertures of the second focusing electrode.

Also, the rim electrode construction on the first focusing electrode forms an inclined electric field for compensating for the misconvergence of the side electron beams between the forward end of the rim electrode and the horizontal plates holding the electron beam passage apertures of the first focusing electrode. Under this condition, the distance of the side electron beam passage aperture from the electron gun is the same for the control electrode, the accelerating electrode, the first focusing electrodes and the second focusing electrodes, and the anode has a greater distance from the electron gun axis of the side electron beam passage aperture than the electrodes in the preceding stage thereby to secure the convergence of the side electron beam.

According to this invention, the same distance is secured of the side electron beam passage aperture of each electrode from the electron gun axis, thus making it possible to assemble an in-line electron gun without any displacement while at the same time producing an electron gun for the color picture tube exhibiting a high resolution characteristic and a satisfactory convergence over the entire area of the phosphor screen surface.

DESCRIPTION OF THE PREFERRED EMBODIMENTS

Figure 7:
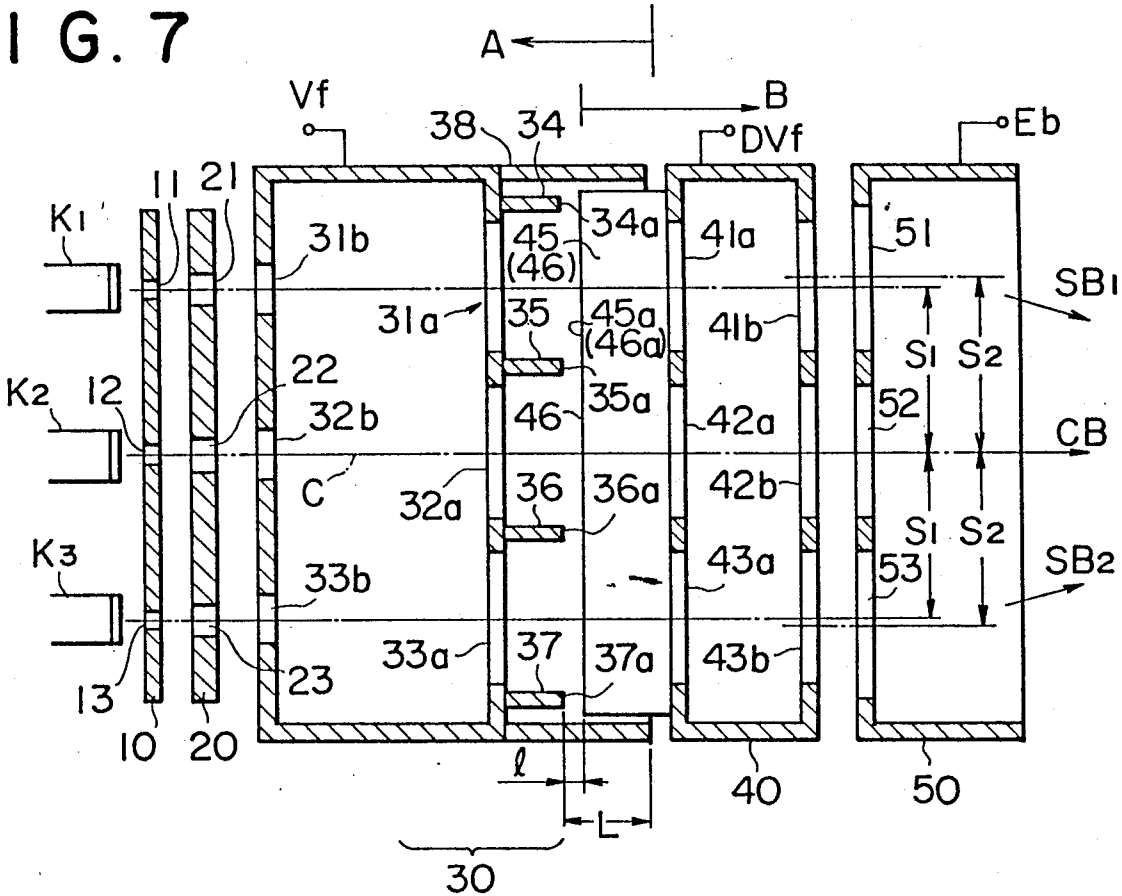
FIG. 7 shows an embodiment of the electron gun for the color picture tube according to the present invention.
Figure 8A:
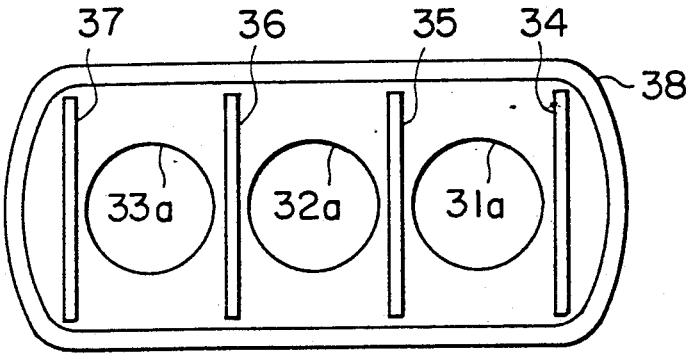
FIGS. 8(*a*), (*d*), (*e*) and (*f*) show an example of the rim electrode of the first focusing electrode used in the embodiment of FIG. 7, and FIGS. 8(*b*) and (*c*) an example of the second focusing ectrode used in the embodiment of FIG. 7.
Figure 8B:
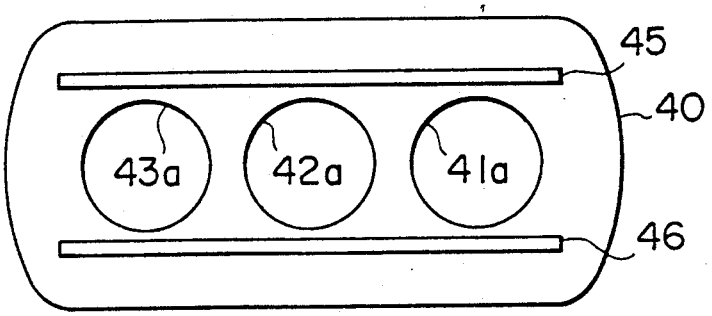
Figure 8C:
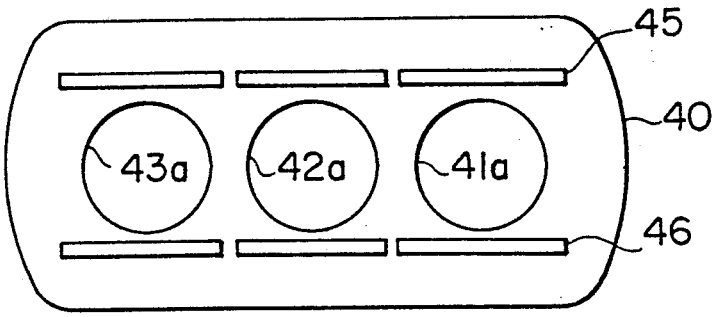
Figure 8D:
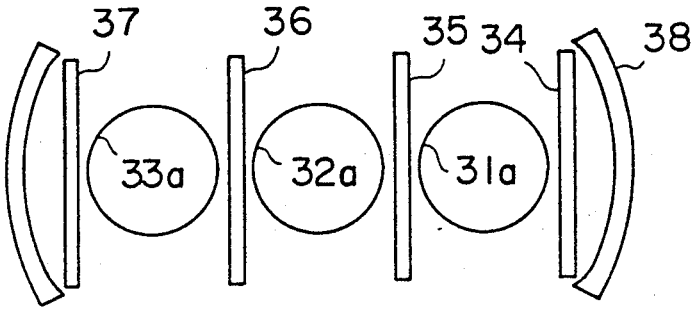
Figure 8E:
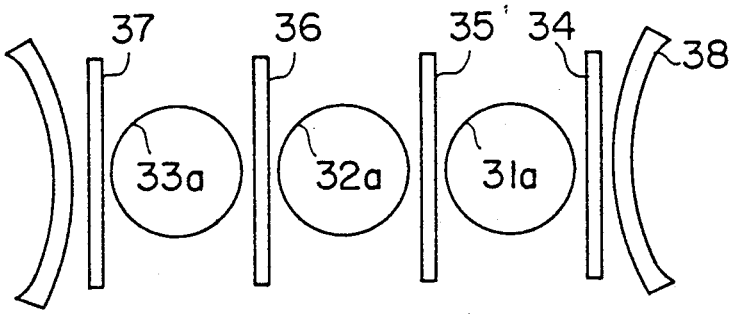
Figure 8F:
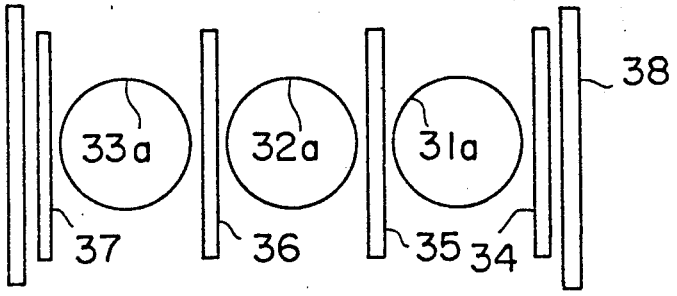

An electron gun for the color picture tube according to an embodiment of the present invention is shown in FIG. 7. FIG. 8(*a*) is a front view of the first focus electrode as viewed from the direction of arrow A in FIG. 7, and FIG. 8(*b*) front view of the second focusing electrode as viewed from the direction of arrow B in FIG. 7. Characters $K_1$, $K_2$ and $K_3$ designate a hot cathode (hereinafter referred to simply as "the cathode"), numeral 10 a control electrode, numeral 20 an accelertaing electrode, numeral 30 a first focusing electrode, numeral 40 a second focusing electrode, numeral 50 an anode, numerals 11, 12, 13, 21, 22, 23, 31*a*, 32*a*, 33*a*, 31*b*, 32*b*, 33*b*, 41*a*, 42*a*, 43*a*, 41*b*, 42*b*, 43*b*, 51, 52 and 53 electron beam passage apertures, character C an electron gun axis, characters CB a center electron beam, and characters $SB_1$ and $SB_2$ side electron beams.

In FIG. 7, an electron gun for the in-line color picture tube is made up of cathodes $K_1$, $K_2$ and $K_3$, the control electrode 10, the accelerating electrode 20, the first focus electrode 30, the second focusing electrode 40 and the anode 50 which is the last accelerating electrode.

The first focusing electrode 30 has a first flat electrode (vertical plate) including three circular electron beam passage apertures 31*a*, 32*a* and 33*a* at the end thereof on the side thereof near to the second focusing electrode 40, and also including four parallel flat plates 34, 35, 36 and 37 erected perpendicularly toward the second focusing electrode 40 while sandwiching the electron beam passage apertures in horizontal direction from the end thereof formed with the electron beam passage apertures in opposed relationship with the second focusing electrode 40. As shown in FIG. 7 and FIG. 8(*a*), a rim electrode 38 surrounds the parallel flat plates 34, 35, 36 and 37 making up the first flat electrode and extends from the forward ends 34*a*, 35*a*, 36*a* and 37*a* by a predetermined distance toward the second focusing electrode 40.

The rim electrode 38, though shown as structurally connected to the first focusing electrode 30, may alternatively be structurally independent of the first focusing electrode 30 and may be electrically connected at the same potential as the first focusing electrode 30.

The second focusing electrode 40, on the other hand, includes a second flat electrode (horizontal plate) having three circular electron beam passage apertures 41*a*, 42*a*, 43*a* on the end thereof near to the first focusing electrode 30 and also having a couple of parallel flat plates 45 and 46 erected horizontally along the direction of the first focusing electrode 30 while sandwiching the electron beam passage apertures from the vertical direction as shown in FIG. 8(*b*). This horizontal plate couple may be provided for each electron beam (that is, in three couples) as shown in FIG. 8(*c*).

The rim electrode 38, as shown in FIGS. 8(*d*) to (*f*), may be arranged on both out sides of the parallel flat plates 34 and 37 along the direction of electron beam alignment in spot symmetry with respect to the central electron beam sandwiched by the parallel flat plates 35 and 36.

The forward ends 45*a* and 46*a* of the parallel flat plates making up the second flat electrode are extended into the rim electrode 38 of the first focusing electrode at predetermined intervals l toward the electron gun axis C from the forward ends 34*a*, 35*a*, 36*a* and 37*a* of the parallel flat plate of the first focusing electrode 30.

The end of the anode 50 has three circular electron beam passage apertures 41*b*, 42*b* and 43*b*. The end of the anode 50 near to the second focusing electrode 40 is formed with three circular electron beam passage apertures 51, 52 and 53. The distance S2 of the side electron beam passage aperture from the electron gun axis C is larger than the distance $S_1$ of the side electron beam passage aperture of the cathodes $K_1$, $K_2$, $K_3$, control electrode 10, accelerating electrode 20, first focusing electrode 30 and the second focusing electrode 40 in preceding stage. The main lenses are thus formed between the second focusing electrode 40 and the anode 50 thereby to converge the side electron beams $SB_1$ and $SB_2$ on the phosphor screen.

The control electrode 10 and the accelerating electrode 20 have three circular electron beam passage apertures 11, 12, 13 and 21, 22, 23 respectively, and three circular electron beam passage apertures 31*b*, 32*b*, 33*b* are formed in the end of the first focusing electrode 30 nearer to the accelerating electrode 20.

Figure 9A:
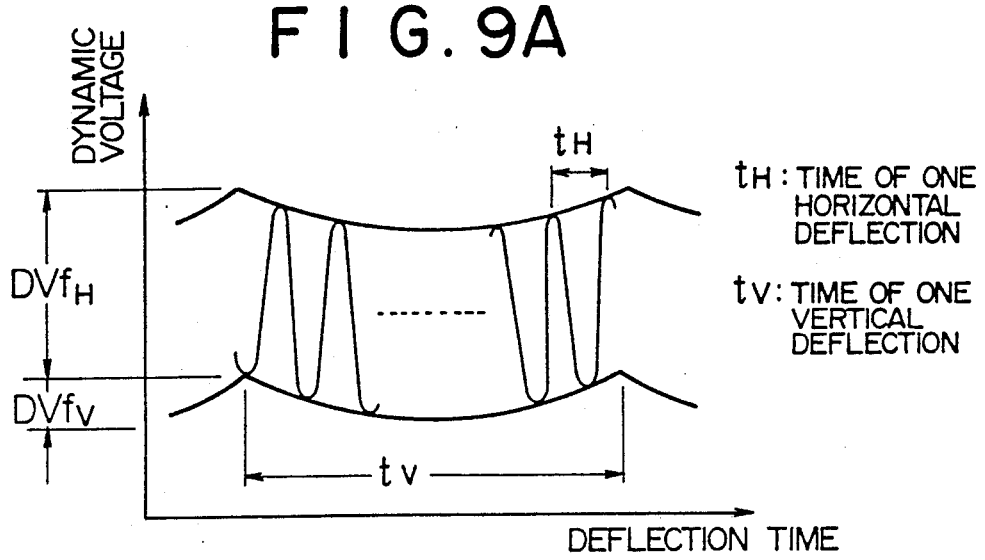
FIGS. 9(*a*), (*b*) and (*c*) show a dynamic focus voltage characteristic applied to the second focusing electrode.
Figure 9B:
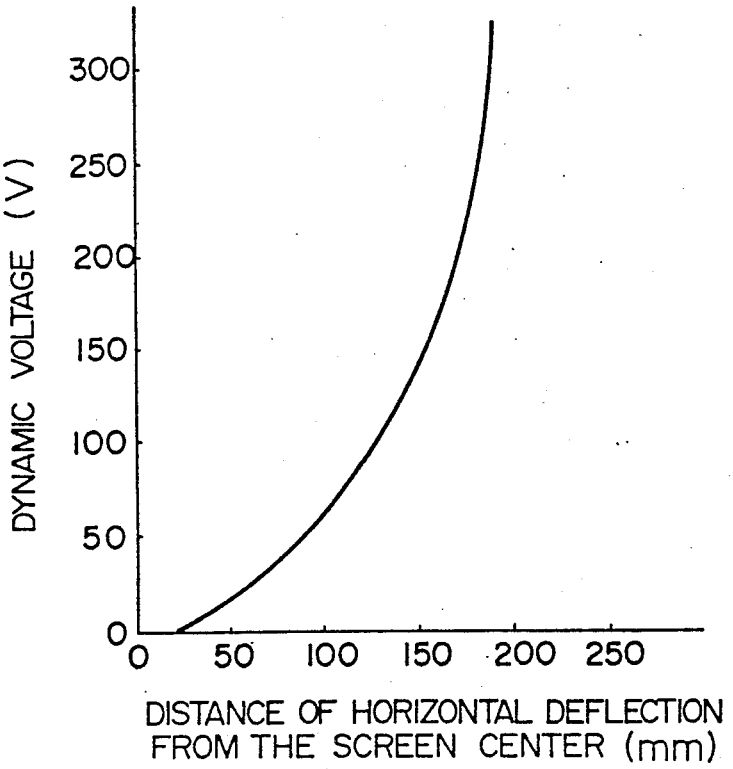
Figure 9C:
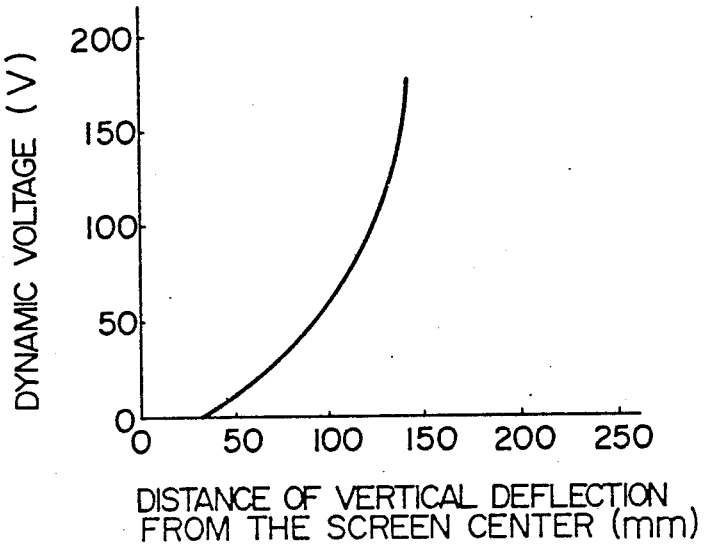

In operation, the voltages applied to the respective electrodes are 50 V to 170 V for the cathode, 0 V for the control electrode, 400 V to 800 V for the accelerating electrode, 5 kv to 8 kv for the first focusing electrode as Vf, and 25 kV to 30 kV as a anode voltage (Eb). The second focusing electrode, as shown in FIG. 9(*a*), is impressed with a dynamic voltage (DVf) changing in synchronism with the vertical and horizontal beam deflections. Specifically, the second focusing electrode 40 is supplied with a voltage $DVf_H$ shown in FIG. 9(*a*) along the horizontal direction of the phosphor screen and the voltage $DVf_H$ along the vertical direction thereof in contrast to the focus voltage Vf applied to the first focusing electrode 30. When the amount of deflection of the electron beam is zero, the dynamic voltage (DVf) is given as a potential of 5 kv to 8 kv equivalent to the potential Vf of the first focusing electrode. The dynamic voltage, as shown in FIGS. 9(*b*) and (*c*), gradually increases with the amount of horizontal and vertical deflections of the electron beam. When the electron beam deflection is maximum, this potential is higher than the first focusing electrode voltage Vf by 0.4 kV to 1 kV.

When the amount of electron beam is zero, there is no potential difference between the first focusing electrode 30 and the second focusing electrode 40 as mentioned above, and therefore the electron beam is not affected by the parallel flat plates (second flat electrode, horizontal plate) 45, 46 mounted on the second focusing electrode 40 o the parallel flat plate (first flat electrode or vertical plate) inside the first focusing electrode, with the result that the electron beams are converged with the optimum focus at the central part of the phosphor screen surface by the main lenses between the second focusing electrode 40 and the 50.

With the increase in the amount of electron beam deflection, however, the potential of the second focusing electrode 40 increases beyond that of the first focusing electrode 30, so that a four-pole lens electric field is formed by the parallel flat plates (vertical plates) 34, 35, 36 and 37 in the first focusing electrode 30 and the parallel flat plates (horizontal plates) 45, 46 mounted on the second focusing electrode 40 while at the same time the potential difference between the second focusing electrode 40 and the anode 50 is reduced thereby to weaken the focusing function of the main lens.

Figure 10A:
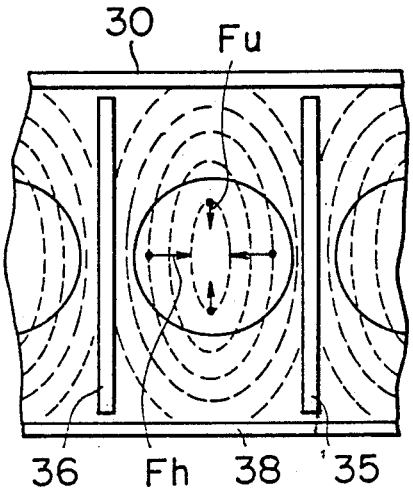
FIGS. 10(*a*) and (*b*) show the function of a four-pole lens electric field due to the first and second focusing electrodes of the electon gun shown in FIG. 7.
Figure 10B:
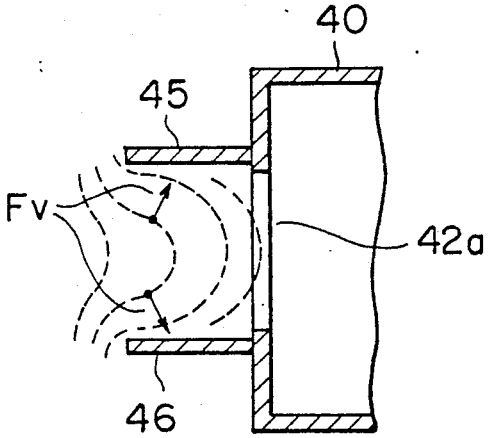

FIGS. 10(*a*) and (*b*) are diagrams for explaining the four-pole lens electric field function by the first and second focusing electrodes of the electron gun shown in FIG. 7, in which FIG. 10(*a*) is a partial front view of the first focusing electrode, and FIG. 10(*b*) a partial sectional view of the second focusing electrode.

In FIGS. 10(*a*) and (*b*), characters Fh, Fu and Fv designate the forces applied to the electron beams by the electric field, and the same component elements as those in FIG. 7 are denoted by like reference numerals.

The electric field formed by the parallel flat plates (vertical plates) 34, 35, 36, 37 within the first focusing electrode 30 and the parallel flat plates (horizontal plates) 45, 46 mounted on the second focusing electrode 40 is what is called a four-pole lens electric field. A loose focusing electric field is formed in vertical direction and a sharp focusing electric field in the horizontal direction between the vertical plates 34 and 35, between 35 and 36, and between 36 and 37 (only the electric field between 35 and 36 is shown) inside the first focusing electrode 30 shown in FIG. 10(*a*), so that electron beams are converged considerably along the horizontal direction by the force of Fh−Fu (Fh>Fu). Also, between the horizontal plates 45 and 46 mounted on the second focusing electrode 40, a scattering lens sharp along vertical direction but substantially not affected along the horizontal direction is formed resulting in a great scattering along the vertical direction by the force Fv.

Figure 1:
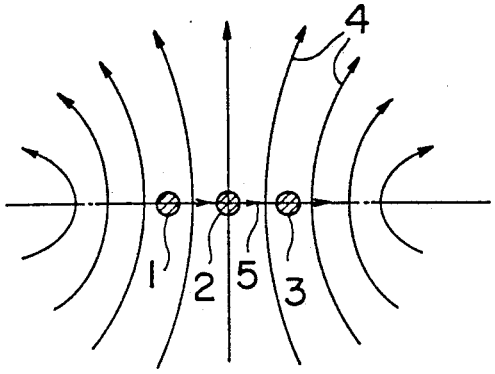
FIG. 1 is a diagram showing the relationship between a four-pole lens magnetic field and electron beams.
Figure 2A:
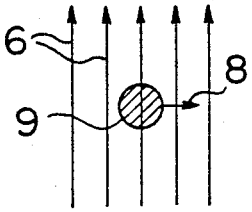
FIGS. 2(*a*), and 2(*b*) show the relationship between the horizontal deflection magnetic field of pin-cushion magnetic field distribution and an electron beam.
Figure 2B:
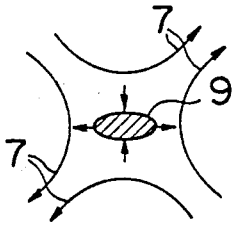
Figure 3:
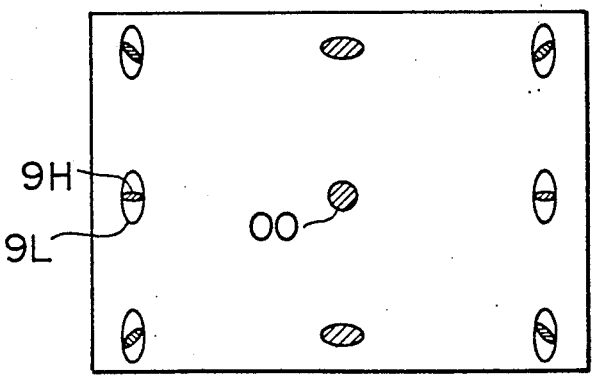
FIG. 3 shows a pattern distortion of the beam spot.
Figure 4A:
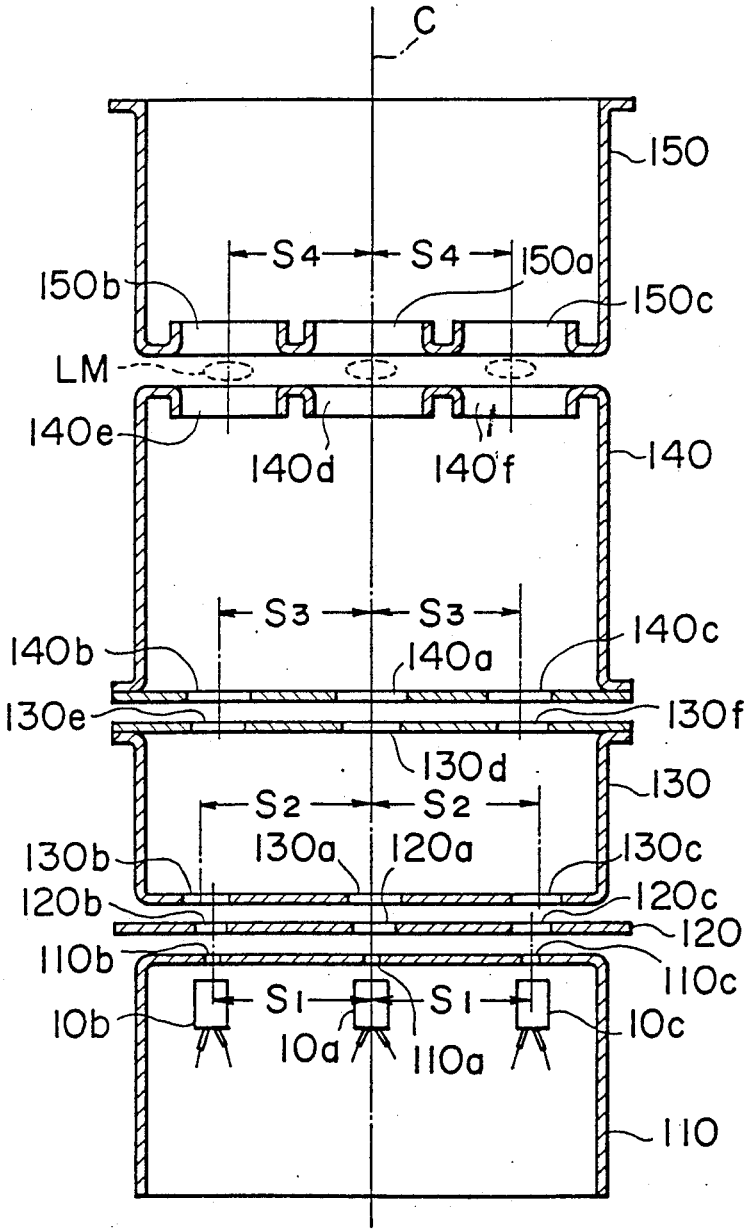
FIG. 4A PRIOR ART
FIGS. 4(*a*), (*b*) and (*c*) show a conventional electron gun for the picture tube.
Figure 4B:
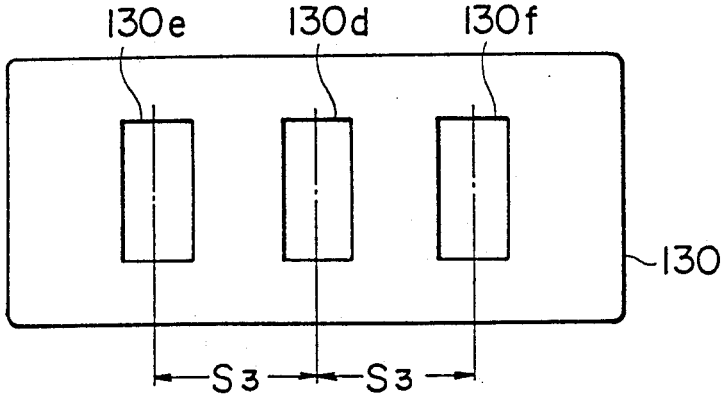
FIG. 4B PRIOR ART
Figure 4C:
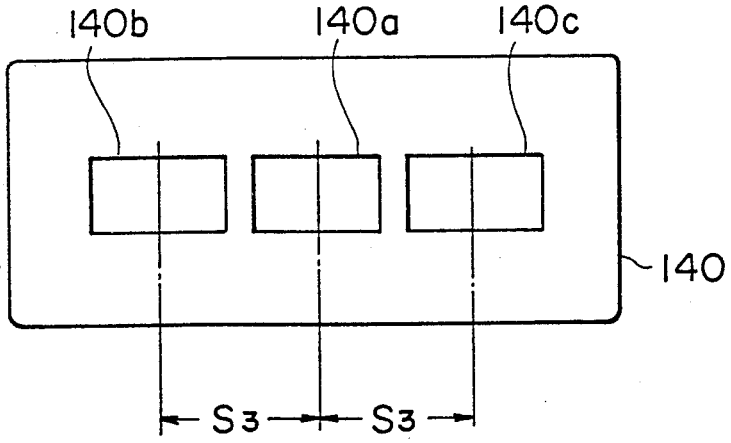
FIG. 4C PRIOR ART
Figure 5:
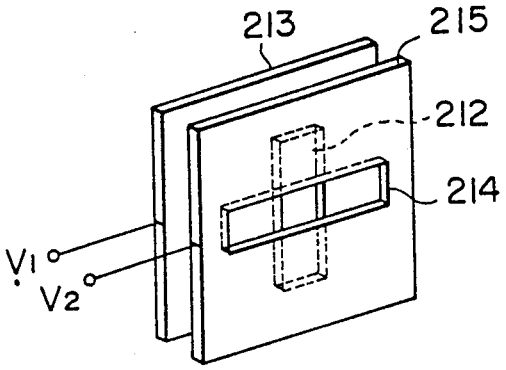
FIGS. 5 and 6 are diagram showing the effect that a four-pole electric field has on an electron beam.
Figure 6:
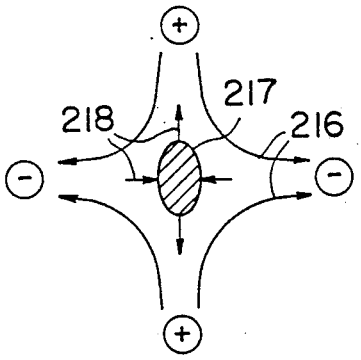

As a consequence, the electron beam has a longitudinal section along the vertical direction between the first focusing electrode 30 and the second focusing electrode 40 in a phenomenon reverse to the case in which the electron beam passing through the deflection magnetic field is distorted into lateral section along the horizontal direction by the four-pole magnetic field components as explained with reference to FIG. 2, with the result that the offsetting of functions between the first and second focusing electrodes prevents the electron beams from laterally flattening.

In view of the fact that the magnification of the main lens decreases with the increase in the electron beam deflection, on the other hand, the electron beams under an increased deflection is over-focused on the phosphor screen to a lesser degree, thus making it possible to converge the electron beams not only at the central part but along the peripheral parts of the phosphor screen with optimum focus and hence to produce a beam spot substantially true in roundness.

Figure 11A:
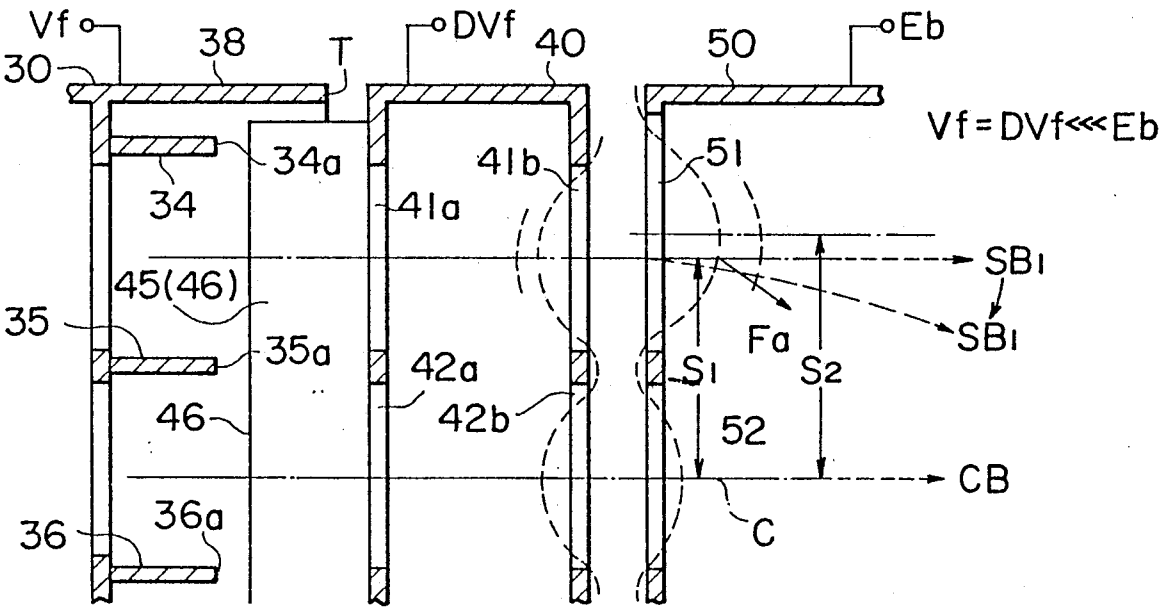
FIGS. 11(*a*) and (*b*) show a convergence system of an electron gun according to the present invention shown in FIG. 7.
Figure 11B:
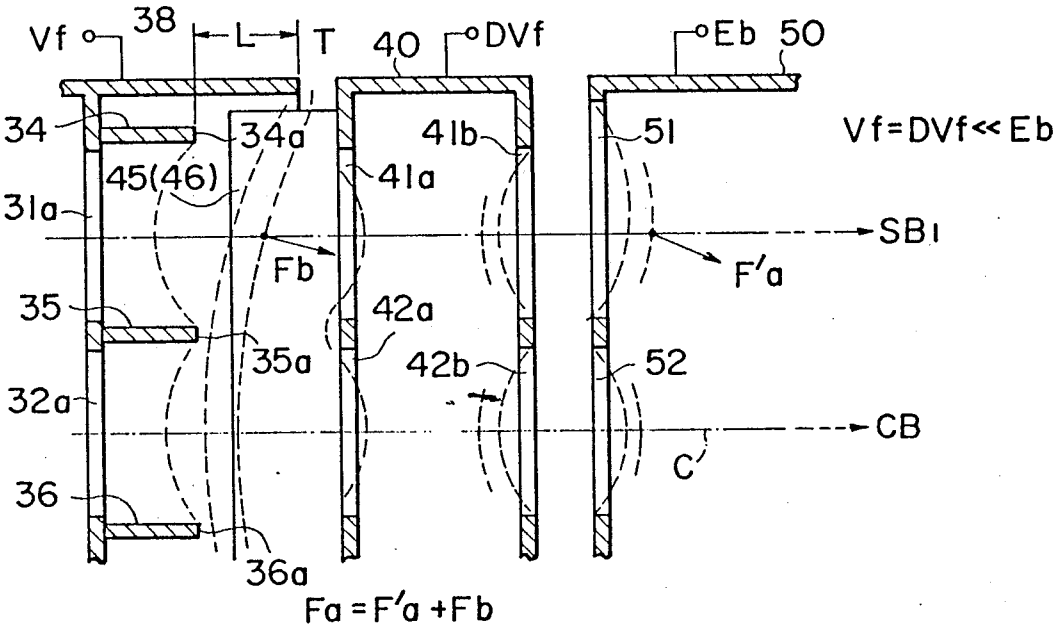

FIGS. 11(*a*) and (*b*) are diagrams for explaining the convergence system of the electron gun according to the present invention shown in FIG. 7. Characters Fa, Fa' and Fb designate forces exerted on the electron beams by the electric field, and those component parts identical to those in FIG. 7 are denoted by the same reference numerals or characters as in FIG. 7. FIG. 11(*a*) is a diagram showing the conditions under deflection at the central part of the phosphor screen, and FIG. 11(*b*) the conditions under deflection at the corners of the phosphor screen.

In FIG. 11(*a*), in view of the fact that the potential Vf of the first focusing electrode 30 is identical to the potential Dvf of the second focusing electrode at the central part of the phosphor screen (Vf =DVF<<<Eb), the distance $S_2$ of the side electron beam passage aperture 51 of the cathode 50 from the electron gun axis C is larger than the distance S1 of the side beam passage aperture 41*b* of the second focusing electrode 40 from the electron gun axis C when the deflection of the electron beam is zero, and therefore the side electron beam passage apertures are displaced outward. Thus the side electron beam $SB_1$ is passed inward of the scattering lens (on center electron beam CB side) formed in the side electron beam passage apertures 51, 53 (53 not shown) of the anode 50, and therefore is curved inwardly by the force Fa toward the center electron beam CB, thereby being converged with the center electron beam CB on the phosphor screen.

In FIG. 11(*b*), when the potential DVf of the second focusing electrode 0 becomes higher than the potential Vf of the first focusing electrode 30 (Vf<DVf<<Eb) with the increase in the amount of electron beam deflection, on the other hand, the potential between the second focusing electrode 40 and the anode 50 is reduced to such an extent that the force Fa' applied to the side electron beams at the side electron beam paassage apertures 51, 53 (53 not shown) of the anode 50 decreases below the force Fa (Fa>Fa'), and the side electron beam SB1' curved toward the center electron beam CB by this force Fa', fails to converge on the phosphor screen with the center electron beam CB. In the process, an electric field inclined inwardly toward the second focusing electrode 40 is formed as shown in FIG. 11(*b*) in an area extending from the forward end T of the rim electrode 38 of the first focusing electrode 30 toward the forward ends 34*a*, 35*a*, 36*a*, 37*a* (37*a* not shown) of the perpendicular plates 34, 35, 36, 37 (37 not shown).

This inclined electric field exerts a focusing function on the electron beams thereby to curve the side electron beam $SB_1$ toward the center electron beam CB by the force Fb.

It is possible to control the magnitude of the inclined electric field within the rim electrode 38 by changing the distance L between the forward end T of the rim electrode 38 and the forward ends 34*a*, 35*a*, 36*a*, 37*a* of the perpendicular plates 34, 35, 36, 37. Against the change in the potential Dvf of the second focusing electrode 40, the Fa' in the direction of the center electron beam CB applied to the side electron beam $SB_1$ passing through the electron beam passage apertures 51, 53 (53 not shown) of the anode 50 by the same passage apertures and the force Fb exerted by the rim electrode 38 combine to have the same effect as the force Fa in FIG. 11(*a*), with the result that the side electron beam $SB_1$ converges with the center electron beam CB even at the corners of the phosphor screen.

In FIG. 11, the horizontal plate 45 (46) on the second focusing electrode 40 is shown mounted into the rim electrode 38. The construction of the horizontal plate 45 is not necessarily limited to this configuration, but the forward end of the horizontal plate may be positioned in proximity to the forward end of the rim electrode 38.

Also, the force Fb shown in FIG. 11(*b*) is generated by protruding the forward end T of the rim electrode 38 toward the second focusing electrode 40 from the forward ends 34*a*, 35*a*, 36*a*, 37*a* of the perpendicular plates 34, 35, 36, 37. This rim electrode 38 has a shield effect of preventing the lens electric field due to the focusing electrodes from being affected by the charged carried in the interior wall of the neck, etc. of the color picture tube.

It will thus be understood from the foregoing description, according to the embodiments described above, side electron beams and a center electron beam are converged with each other over the enter surface of the phosphor screen with a small diameter of beam spot substantially true in roundness, that is, without deteriorating the resolution.

The present invention is applicable not only to the electron gun with a single stage of focusing electrodes described above but also to an electron gun having multiple stages of focusing electrodes as well.

The present invention is neither limited to an in-line three-electron-beam electron gun having three anodes as shown in the embodiments mentioned above, but may also be applied with equal effect to various electron guns having a plurality of electron beams other than three or electron guns having a single anode shared by three electron beams.

We claim:

1. An electron gun for the color picture tube, comprising a cathode for emitting three electron beams aligned along a direction, and an accelerating electrode, focusing electrodes and an anode arranged in axial direction of the electron gun in that order:

said focusing electrodes including a first focusing electrode arranged nearer to the accelerating electrode and a second focusing electrode arranged nearer to said anode, each having a plurality of electron beam passage apertures for passing the three electron beams emitted from said cathode;

said first focusing electrode including a first flat electrode having a plurality of parallel flat plates secured thereto in the direction toward the second focusing electrode while sandwiching each of the electron beams along the direction of arrangement thereof after being passed through the electron passage apertures formed in the end thereof opposed to the second focusing electrode, said first focusing electrode further including a rim electrode surrounding said first flat electrode;

said second focusing electrode including a second flat electrode having a couple of parallel flat plates erected toward the first focusing electrode and extending along the electron gu axis in opposed relationship with each other while sandwiching the electron beams along the direction perpendicular to the direction of arrangement of the electron beams after being passed through the electron beam passage apertures formed in the end of the second focusing electrode opposed to the first focusing electrode;

said electron gun further comprising voltage application means for applying a predetermined focus voltage to said first focusing electrode and a voltage changing to a value higher than the focus voltage with the increase in the electron beam deflection to said second focusing electrode.

2. An electron gun for the color picture tube, comprising a cathode for emitting three electron beams aligned along one direction, and an accelerating electrode, a couple of focusing electrodes and an anode arranged in axial direction of the electron gun in that order;

said focusing electrodes including a first focusing electrode arranged nearer to the accelerating electrode and a second focusing electrode arranged nearer to said anode, each having a plurality of electron beam passage apertures for passing the three electron beams emitted from said cathode;

said first focusing electrode including a first flat electrode having a plurality of parallel flat plates secured thereto in the direction toward the second focusing electrode while sandwiching each of the electron beams along the direction of arrangement thereof after being passed through the electron beam passage apertures formed in the end thereof opposed to the second focusing electrode, said first focusing electrode further including a rim electrode surrounding said first flat electrode;

said second focusing electrode including a second flat electrode having a couple of parallel flat plates erected for each electron beam toward the first focusing electrode and extending along the electron gun axis in opposed relationship with each other while sandwiching the electron beams along the direction perpendicular to the direction of arrangement of the electron beams after being passed through the electron beam passage apertures formed in the end of the second focusing electrode opposed to the first focusing electrode;

said electron gun further comprising voltage application means for applying a predetermined focus voltage to said first focusing electrode and a voltage changing to a value higher than the focus voltage with the increase in the electron beam deflection to said second focusing electrode.

3. An electron gun for the color picture tube according to claim 1, wherein said second flat electrode extends into said rim electrode.

4. An electron gun for the color picture tube according to claim 2, wherein said second flat electrode extends into said rim electrode.

5. An electron gun for the color picture tube according to claim 1, wherein the electron beam passage apertures formed in the first focusing electrode are selected one of three longitudinal apertures having a longer diameter perpendicular to the direction of electron beam alignment and three circular apertures for passing the three electron beams separately; and the electron beam passage apertures formed in the second focusing electrode are selected one of three longitudinal apertures having a longer diameter along the direction of electron beam alignment and three circular apertures for passing the three electron beams separately.

6. An electron gun for the color picture tube according to claim 2, wherein said electron beam passage apertures formed in the first focusing electrode are selected one of three longitudinal apertures having a longer diameter along the direction of electron beam arrangement and three circular apertures for passing the three electron beams separately; and the electron beam passage apertures formed in the second focusing electrode are selected one of three lateral apertures having a longer diameter along the direction of electron beam arrangement and circular apertures for passing said three electron beams therethrough separately from each other.

7. An electron gun for the color picture tube according to claim 3, wherein the electron beam passage apertures formed in the first focusing electrode are selected one of three longitudinal apertures having a longer diameter perpendicular to the direction of the electron beam arrangement and three circular apertures for passing the three electron beams separately; and the electron beam passage apertures formed in the second focusing electrode are selected one of lateral apertures having a longer diameter along the direction of electron beam arrangement and three circular apertures for passing the three electron beams.

8. An electron gun for the color picture tube according to claim 4, wherein said electron beam passage apertures formed in said first focusing electrode are selected one of three longitudinal apertures having a longer diameter perpendicular to the direction of electron beam arrangement and three circular apertures for passing the three electron beams separately; and the electron beam passage apertures formed in the second focusing electrode are selected one of three lateral apertures having a longer diameter along the direction of the electron beam arrangement and three circular apertures for passing the three electron beams separately.

9. An electron gun for the color picture tube, comprising an anode for emitting three electron beams in alignment, a couple of focusing electrode for focusing the electron beams emitted from said cathode, and voltage application means for applying a predetermined voltage to said focusing electrodes; wherein said focusing electrodes include first and second focusing electrodes having apertures for passing the electron beams and arranged along the axis of the electron gun;

said first focusing electrode includes a first flat plate electrode having a plurality of parall flat electrodes arranged to sandwich the electron beams sequentially along the direction of arrangement thereof after being passed through the electron beam passage apertures and extending perpendicularly toward said second focusing electrode, said first focusing electrode further including a rim electrode surrounding the first flat plate electrode and extending toward said second focusing electrode by a length greater than said first flat plate electrode;

said second focusing electrode includes a second flat plate electrode having at least a couple of parallel flat plate electrodes arranged in such a manner as to sandwich said electron beams from the direction perpendicular to the direction of arranegment of the electron beams after being passed through the passage apertures and extending in the horizontal direction in such a manner as to be opposed to said first flat plate electrode and said rim electrode by a predetermined distance along the axis of the electron gun and extending into the rim electrode; and said voltage application means applies a predetermined focus voltage to said first focusing electrode and applying to said second focusing electrode a dynamic voltage adapted to change to a value higher than said focus voltage with the increase in the electron beam deflection.

10. An electron gun for the color picture tube, comprising:

a cathode for emitting three electron beams in alignment;

focusing electrodes including first and second focusing electrodes each having a plurality of apertures for passing the electron beams and arranged along the axis of the electron gun for focusing the electron beams emitted from said cathode;

wherein said first focusing electrode includes a first flat plate electrode having a plurality of parallel flat electrodes arranged to sandwich each of the electron beams after being passed through said electron beam passage apertures and perpendicularly extending toward said second focusing electrodes, and a couple of rim electrodes arranged nearer to said flat plate electrode along the direction of electron beam arrangement and extending toward said second focusing electrode beyond said first flat plate electrode on the sides of said first flat plate electrode; and said second focusing electrode includes a second flat plate electrode having at least a couple of parallel flat electrodes arranged in such a manner as to sandwich said electron beams along the direction perpendicular to the direction of electron beam arrangement after being passed through the electron beam passage apertures, said parallel flat plate electrodes extending horizontally along the axial direction of the electron gun in opposed relationship with said first flat plate electrode and said rim electrodes;

said electron gun further comprising voltage application means for applying a predetermined focus voltage to said first focusing electrode and applying to said second focusing electrode a dynamic voltage adapted to change to a value higher than the focus voltage with the increase in the deflection angle of the electron beams.

11. An electron gun for the color picture tube, comprising:

a cathode for emitting three electron beams in alignment;

a first focusing electrode including a first flat plate electrode having a plurality of parallel flat electrodes formed with apertures for passing electron beams emitted from said cathode, and extending in the direction perpendicular to the electron gun axis, said parallel flat electrodes being arranged sequentially in such a manner as to sandwich electron beams along the direction of arrangement thereof after being passed through said passage apertures, and a couple of flat plate rim electrodes extending along the electron gun axis beyond said first flat plate electrode and arranged on the sides of said first flat plate electrode along the direction of electron beam arrangement in spot symmetry to each other with respect to the central electron beam sandwiched by said parallel flat plate electrodes;

a second focusing electrode including at least a couple of parallel flat plate electrodes arranged in such a manner as to sandwich the electron beams in the direction perpendicular to the electron beam arrangement after being passed through the passage apertures of said first focusing electrode, said second flat plate electrodes being extended horizontally and arranged in opposed relationship with said first flat plate electrode and said rim electrodes along the electron gun axis by a predetermined distance; and voltage application means for applying a predetermined focus voltage to said first focusing electrode and applying to said second focusing electrode a dynamic voltage adapted to change to a value higher than said focus voltage with the increase in the deflection amount of the electron beams.

12. An electron gun for the color picture tube, comprising:

a plurality of cathodes arranged in alignment for emitting three electron beams;

a first focusing electrode including a first flat plate electrode having a plurality of parallel flat plate electrodes formed with a plurality of apertures for passing the electron beams emitted from said cathodes, said parallel flat plate electrodes extending along the electron gun axis in such a manner as to sandwich the electron beams sequentially along the direction of arrangement thereof after being passed through said passage apertures;

a couple of flat plate rim electrodes extending along the electron gun axis beyond the flat plate electrodes of the first focusing electrode and arranged on the sides of said first flat plate electrode along the direction of electron beam arrangement in spot symmetry to each other with respect to the central electron beam sandwiched by the parallel flat plate electrodes of said flat plate electrode;

a second focusing electrode including a second flat plate electrode having at least a couple of parallel flat plate electrodes arranged in such a manner as to sandwich the electron beams along the direction of arrangement thereof after being passed through said passage apertures of said first focusing electrode and extending horizontally in such a manner as to be opposed to said first flat plate electrode and said rim electrodes by a predetermined distance along the electron gun axis; and voltage application means for applying a predetermined focus voltage to said first focusing electrode and also applying to said second focusing electrode a dynamic voltage adapted to change to a value higher than said focus voltage with the increase in the amount of electron beam deflection.

* * * * *